US006340147B1

(12) United States Patent
Dymarczyk

(10) Patent No.: US 6,340,147 B1
(45) Date of Patent: Jan. 22, 2002

(54) FENCE POST HOLDER

(76) Inventor: Jeff Dymarczyk, 243 Laurel Hill Ave., Norwich, CT (US) 06360

( * ) Notice: Subject to any disclaimer, the term of this patent is extended or adjusted under 35 U.S.C. 154(b) by 0 days.

(21) Appl. No.: 09/625,192

(22) Filed: Jul. 21, 2000

(51) Int. Cl.[7] ..... F16M 11/00
(52) U.S. Cl. ..... 248/530; 248/156
(58) Field of Search ..... 248/156, 530, 248/545, 546

(56) References Cited

U.S. PATENT DOCUMENTS

| | | | | |
|---|---|---|---|---|
| 3,698,144 A | * | 10/1972 | Stratton | 52/99 |
| D276,588 S | | 12/1984 | Fambrough | |
| D277,643 S | | 2/1985 | Fambrough | |
| 4,588,157 A | * | 5/1986 | Mills | 248/530 X |
| 4,923,165 A | | 5/1990 | Cockman | |
| 5,011,107 A | | 4/1991 | Reece | |
| 5,090,656 A | | 2/1992 | Brown | |
| 5,135,192 A | | 8/1992 | Winkler | |
| D359,437 S | * | 6/1995 | Bilotti | D8/349 |
| 5,881,495 A | * | 3/1999 | Clark | 248/530 X |

FOREIGN PATENT DOCUMENTS

| | | | |
|---|---|---|---|
| DE | 296 06 117 U1 | * | 9/1996 |
| GB | 2 261 887 A | * | 6/1993 |

* cited by examiner

*Primary Examiner*—Daniel P. Stodola
*Assistant Examiner*—Erica B Harris

(57) ABSTRACT

A fence post holder for holding fence posts in the ground. The fence post holder includes a support portion that has a closed bottom, an open top and a perimeter side wall extending between the closed bottom and the open top to define an interior space adapted for receiving a base of a fence post inserted through the open top. The insertion portion extends downwardly from the support portion. The insertion portion has a bottom point whereby the insertion portion is adapted for facilitating insertion of the insertion portion into a ground surface.

10 Claims, 2 Drawing Sheets

FENCE POST HOLDER

BACKGROUND OF THE INVENTION

1. Field of the Invention

The present invention relates to fence post holders and more particularly pertains to a new fence post holder for holding fence posts in the ground.

2. Description of the Prior Art

The use of fence post holders is known in the prior art. More specifically, fence post holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,135,192; 5,090,656; 4,923,165; U.S. Pat. No. Des. 276,588; U.S. Pat. No. Des. 277,643; U.S. Pat. No. 5,011,107; U.S. Pat. No. Des. 844,726; U.S. Pat. Nos. 4,271,646; 4,644,713; 5,568,909; 4,860,940; and U.S. Pat. No. Des. 164,994.

While these devices fulfill their respective, particular objectives and requirements, the aforementioned patents do not disclose a new fence post holder. The inventive device includes a support portion that has a closed bottom, an open top and a perimeter side wall extending between the closed bottom and the open top to define an interior space designed for receiving a base of a fence post inserted through the open top. The insertion portion extends downwardly from the support portion. The insertion portion has a bottom point whereby the insertion portion is designed for facilitating insertion of the insertion portion into a ground surface.

In these respects, the fence post holder according to the present invention substantially departs from the conventional concepts and designs of the prior art, and in so doing provides an apparatus primarily developed for the purpose of holding fence posts in the ground.

SUMMARY OF THE INVENTION

In view of the foregoing disadvantages inherent in the known types of fence post holders now present in the prior art, the present invention provides a new fence post holder construction wherein the same can be utilized for holding fence posts in the ground.

The general purpose of the present invention, which will be described subsequently in greater detail, is to provide a new fence post holder apparatus and method which has many of the advantages of the fence post holders mentioned heretofore and many novel features that result in a new fence post holder which is not anticipated, rendered obvious, suggested, or even implied by any of the prior art fence post holders, either alone or in any combination thereof.

To attain this, the present invention generally comprises a support portion that has a closed bottom, an open top and a perimeter side wall extending between the closed bottom and the open top to define an interior space adapted for receiving a base of a fence post inserted through the open top. The insertion portion extends downwardly from the support portion. The insertion portion has a bottom point whereby the insertion portion is adapted for facilitating insertion of the insertion portion into a ground surface.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new fence post holder apparatus and method that has many of the advantages of the fence post holders mentioned heretofore and many novel features that result in a new fence post holder which is not anticipated, rendered obvious, suggested or even implied by any of the prior art fence post holders, either alone or in any combination thereof.

It is another object of the present invention to provide a new fence post holder which may be easily and efficiently manufactured and marketed.

It is a further object of the present invention to provide a new fence post holder which is of a durable and reliable construction.

An even further object of the present invention is to provide a new fence post holder which is susceptible of a low cost of manufacture with regard to both materials and labor, and which accordingly is then susceptible of low prices of sale to the consuming public, thereby making such fence post holder economically available to the buying public.

Still yet another object of the present invention is to provide a new fence post holder that provides in the apparatuses and methods of the prior art some of the advantages thereof, while simultaneously overcoming some of the disadvantages normally associated therewith.

Still another object of the present invention is to provide a new fence post holder for holding fence posts in the ground.

Yet another object of the present invention is to provide a new fence post holder which includes a support portion that has a closed bottom, an open top and a perimeter side wall extending between the closed bottom and the open top to define an interior space adapted for receiving a base of a fence post inserted through the open top. The insertion portion extends downwardly from the support portion. The insertion portion has a bottom point whereby the insertion portion is adapted for facilitating insertion of the insertion portion into a ground surface.

Still yet another object of the present invention is to provide a new fence post holder that holds fence posts of any shape in the ground.

Even still another object of the present invention is to provide a new fence post holder that holds fence posts of any shape or size in the ground.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
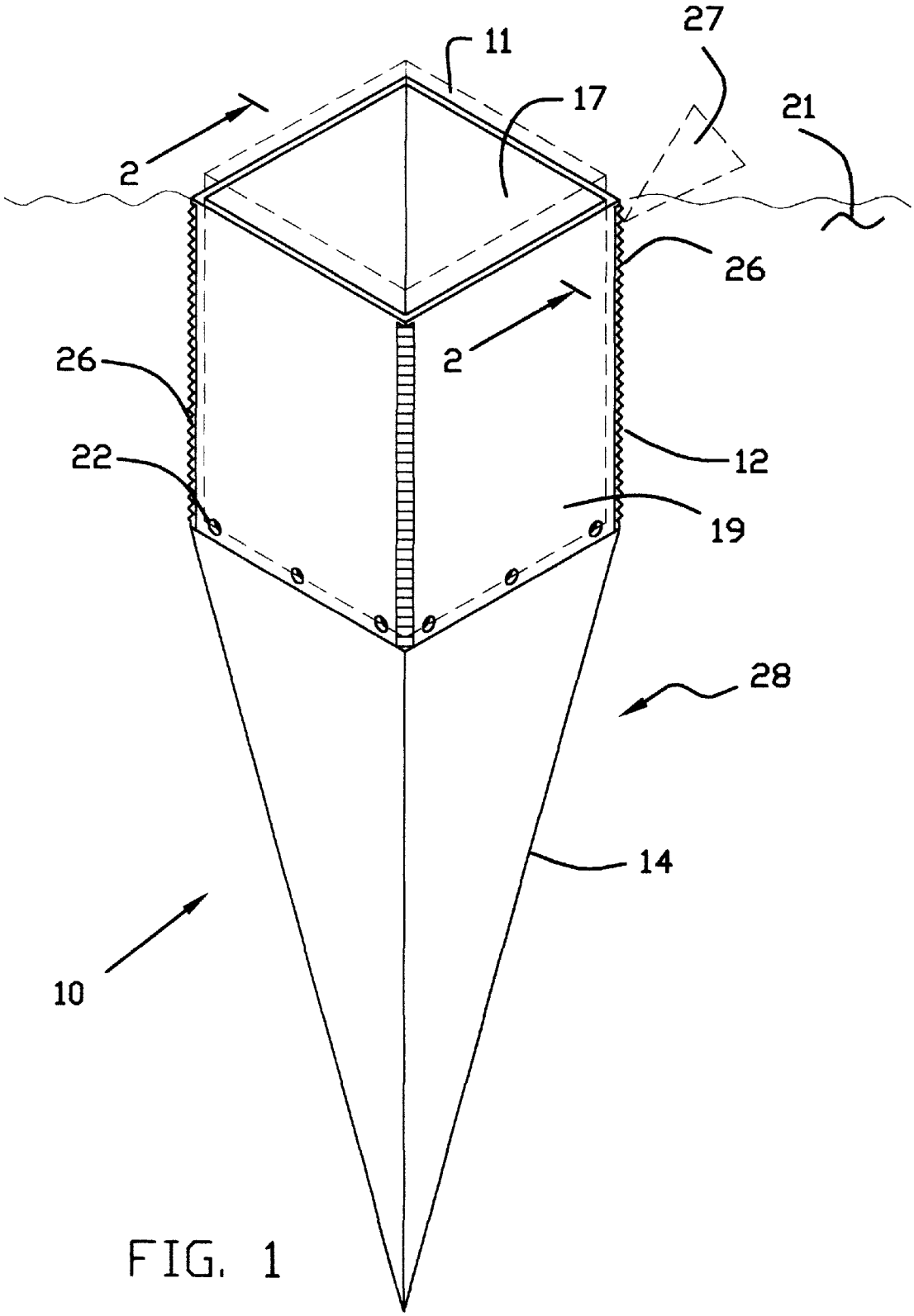
FIG. 1 is a perspective view of a new fence post holder according to the present invention.
Figure 2:
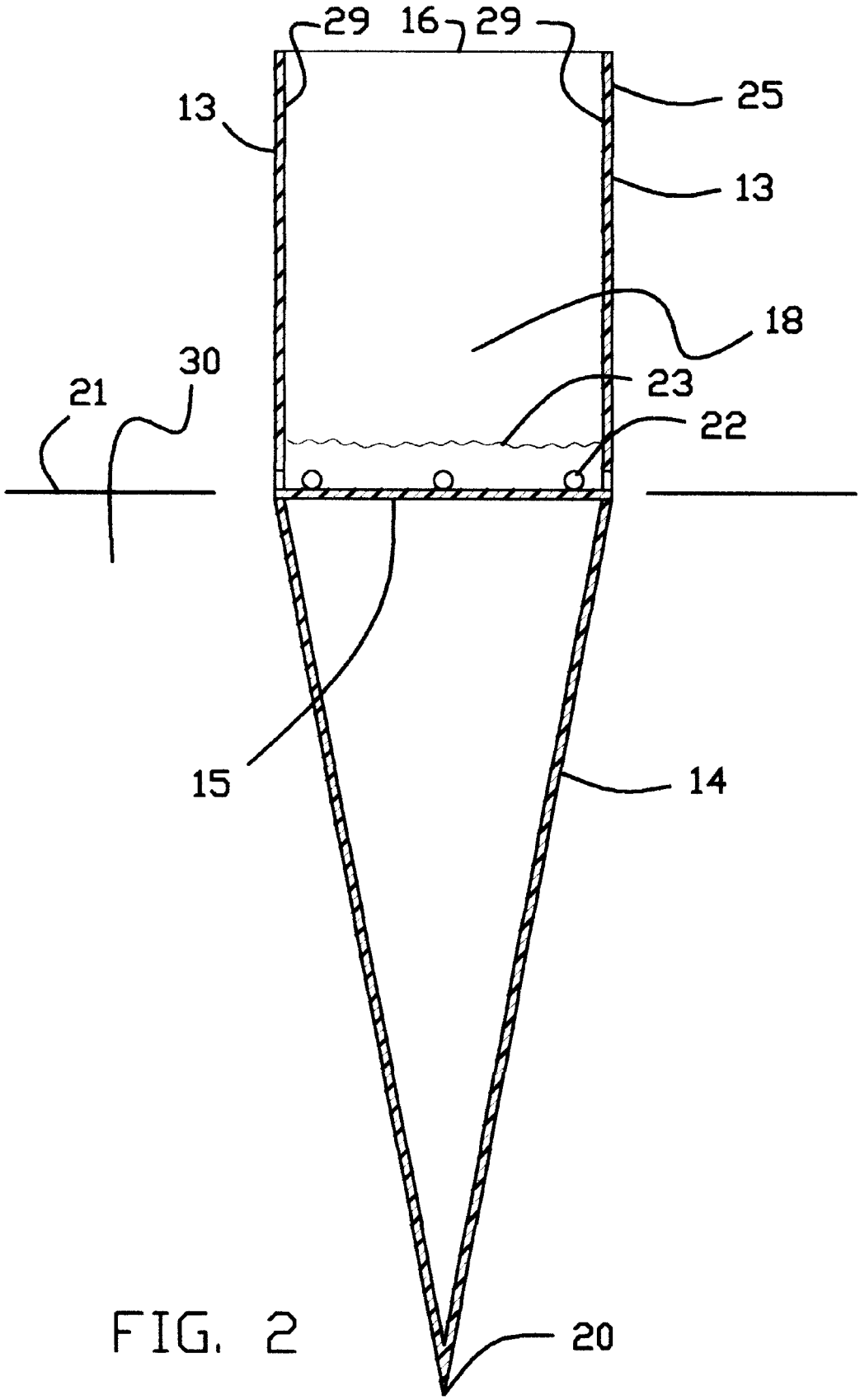
FIG. 2 is a cross section view of the present invention.

With reference now to FIGS. 1 through 2, a new fence post holder embodying the principles and concepts of the present invention and generally designated by the reference numeral 10 will be described.

As best illustrated in FIGS. 1 through 2, the fence post holder 10 generally comprises a fence post 11, along with a fence post support member 12 that has a support portion 13 and an insertion portion 14.

The support portion 13 has a closed bottom 15, an open top 16 and a generally square perimeter side wall 17. The side wall 17 extends between the closed bottom 15 and the open top 16 to define an interior space 18 for receiving a base 19 of the fence post 11 when the base 19 of the fence post 11 is inserted through the open top 16.

The insertion portion 14 extends downwardly from the support portion 13. The insertion portion 14 has a bottom 20 point. The insertion portion 14 is for facilitating insertion of the insertion portion 14 into a ground surface 21 such that ground surrounds the insertion portion 14 and the support portion 13.

The perimeter wall 17 is structured to include a plurality of drainage holes 22. The drainage holes 22 are adapted for draining a liquid 23 from the interior space 18.

Each of the drainage holes 22 is positioned proximate the closed bottom 15 such that the drainage holes 22 are positioned in spaced relationship to each other around a circumference of the perimeter wall 17.

The perimeter wall 17 of the support portion 13 has a plurality of exterior edges 25 extending between the closed bottom 15 and the open top 16. Each of the exterior edges 25 has a plurality of teeth 26 for facilitating removal of the fence support device 10 from the ground 30 using a shovel 27.

In an embodiment, the plurality of teeth 26 of each exterior edge 25 extends the full length between the closed bottom 15 and the open top 16.

In an embodiment, the insertion portion 14 is generally pyramid shaped. The closed bottom 15 of the support portion 13 form a base 28 of the pyramid shape such that the pyramid shape is in an inverted position when the fence post support device 10 is inserted into the ground surface 21. In an embodiment, the insertion portion 14 is hollow for minimizing weight of the fence post support device 10.

In an embodiment, the base 19 of the fence post 11 has a round cross-section taken transverse to a longitudinal axis of the fence post 11. The distance measured orthogonally between opposite interior faces 29 of the perimeter wall 17 is equal to a diameter of the cross-section of the fence post 11. Thus, the fence post 11 abuts each of the interior faces 29 of the perimeter wall 17 for supporting the fence post 11 in an upright position when the fence post support member 12 is inserted into the ground 30 and the fence post 11 is inserted into the support portion 13 of the fence post support member 12.

In an embodiment, the perimeter wall 17 has a height of about 12 inches to provide sufficient support to the fence post and a stable base when inserted into the ground.

In use, the insertion portion of the fence post holder is inserted into the ground so that the closed bottom of the support member is relatively level with a ground surface. The fence post is then positioned in the fence post holder.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fence post support device comprising:

a support portion having a closed bottom, an open top and a perimeter side wall extending between said closed bottom and said open top to define an interior space adapted for receiving a base of a fence post inserted through said open top; and an insertion portion extending downwardly from said support portion, said insertion portion having a bottom point whereby said insertion portion is adapted for facilitating insertion of said insertion portion into a ground surface; and said perimeter wall of said support portion having a plurality of exterior edges extending between said closed bottom and said open top, each of said exterior edges having a plurality of teeth for facilitating removal of said fence support device from the ground using a garden tool.

2. The fence post support device of claim 1, further comprising:

said plurality of teeth of each exterior edge extending a full length between said closed bottom and said open top.

3. The fence post support device of claim 1, further comprising:

said perimeter wall being structured to include a plurality of drainage holes whereby said drainage holes are adapted for draining a liquid from said interior space.

4. The fence post support device of claim 3, further comprising:

each of said drainage holes being positioned proximate said closed bottom such that said drainage holes are positioned in spaced relationship to each other around a circumference of said perimeter wall.

5. The fence post support device of claim 1, further comprising:

said perimeter wall being generally square shaped.

6. The fence post support device of claim 5, further comprising:

said insertion portion being generally pyramid shaped, said closed bottom of said support portion forming a base of said pyramid shape such that said pyramid shape is in an inverted position when said fence post support device is inserted into the ground surface.

7. The fence post support device of claim 6, further comprising:

said insertion portion being hollow for minimizing weight of said fence post support device.

8. A fence post support system comprising:

a fence post;

a fence post support member having a support portion and an insertion portion;

said support portion having a closed bottom, an open top and a generally square perimeter side wall extending between said closed bottom and said open top to define an interior space for receiving a base of said fence post when said base of said fence post is inserted through said open top;

said insertion portion extending downwardly from said support portion, said insertion portion having a bottom point whereby said insertion portion is adapted for facilitating insertion of said insertion portion into a ground surface such that ground surrounds said insertion portion and said support portion;

said perimeter wall being structured to include a plurality of drainage holes whereby said drainage holes are adapted for draining a liquid from said interior space;

each of said drainage holes being positioned proximate said closed bottom such that said drainage holes are positioned in spaced relationship to each other around a circumference of said perimeter wall;

said perimeter wall of said support portion having a plurality of exterior edges extending between said closed bottom and said open top, each of said exterior edges having a plurality of teeth for facilitating removal of said fence support device from the ground using a shovel;

said plurality of teeth of each exterior edge extending a full length between said closed bottom and said open top;

said insertion portion being generally pyramid shaped, said closed bottom of said support portion forming a base of said pyramid shape such that said pyramid shape is in an inverted position when said fence post support device is inserted into the ground surface; and said insertion portion being hollow for minimizing weight of said fence post support device.

9. The fence post support system of claim 8, further comprising:

said base of said fence post having a round cross-section taken transverse to a longitudinal axis of said fence post; and a distance measured orthogonally between opposite interior faces of said perimeter wall being equal to a diameter of said cross-section of said fence post whereby said fence post abuts each of said interior faces of said perimeter wall for supporting said fence post in an upright position when said fence post support member is inserted into the ground and said fence post is inserted into said support portion of said fence post support member.

10. The fence post support system of claim 9, further comprising:

said perimeter wall having a height of about 12 inches.

* * * * *